US007817813B2

(12) United States Patent
Kang et al.

(10) Patent No.: US 7,817,813 B2
(45) Date of Patent: Oct. 19, 2010

(54) WOOFER SPEAKER MOUNTING STRUCTURE FOR PORTABLE COMPUTER

(75) Inventors: Lai O Kang, Osan-si (KR); Seong Ho Lee, Anyang-si (KR)

(73) Assignee: LG Electronics Inc., Seoul (KR)

( * ) Notice: Subject to any disclaimer, the term of this patent is extended or adjusted under 35 U.S.C. 154(b) by 1388 days.

(21) Appl. No.: 11/261,618

(22) Filed: Oct. 31, 2005

(65) Prior Publication Data

US 2006/0215865 A1 Sep. 28, 2006

(30) Foreign Application Priority Data

Mar. 18, 2005 (KR) ..... 10-2005-0022854

(51) Int. Cl.
*H04R 1/02* (2006.01)
*H04R 9/06* (2006.01)
*H04R 5/02* (2006.01)

(52) U.S. Cl. ..... 381/333; 381/306; 381/388

(58) Field of Classification Search ..... 381/333
See application file for complete search history.

(56) References Cited

U.S. PATENT DOCUMENTS 5,668,882 A * 9/1997 Hickman et al. ..... 381/300
6,798,654 B2 * 9/2004 Chang et al. ..... 361/679.23

* cited by examiner

*Primary Examiner*—Curtis Kuntz
*Assistant Examiner*—Matthew Eason
(74) *Attorney, Agent, or Firm*—Ked & Associates LLP

(57) ABSTRACT

Embodiments of a portable computer, a woofer speaker mounting structure for a portable computer and methods thereof can reduce transmission of vibrations from speaker to remaining portions of the portable computers. A woofer speaker mounting structure for a portable computer can include a case, a woofer speaker for producing bass sound positioned on the case and formed with support pieces, dampers for absorbing vibration from the woofer speaker can fit into the support pieces and can be coupled to the case. The damper can include a damper body made of an elastic material and through which a central hole is bored and shock-absorbing portions. Due to the structural and material properties of the damper, vibrations are also absorbed. Therefore, the operational characteristics of a portable computer are improved.

18 Claims, 5 Drawing Sheets

【FIG. 1】
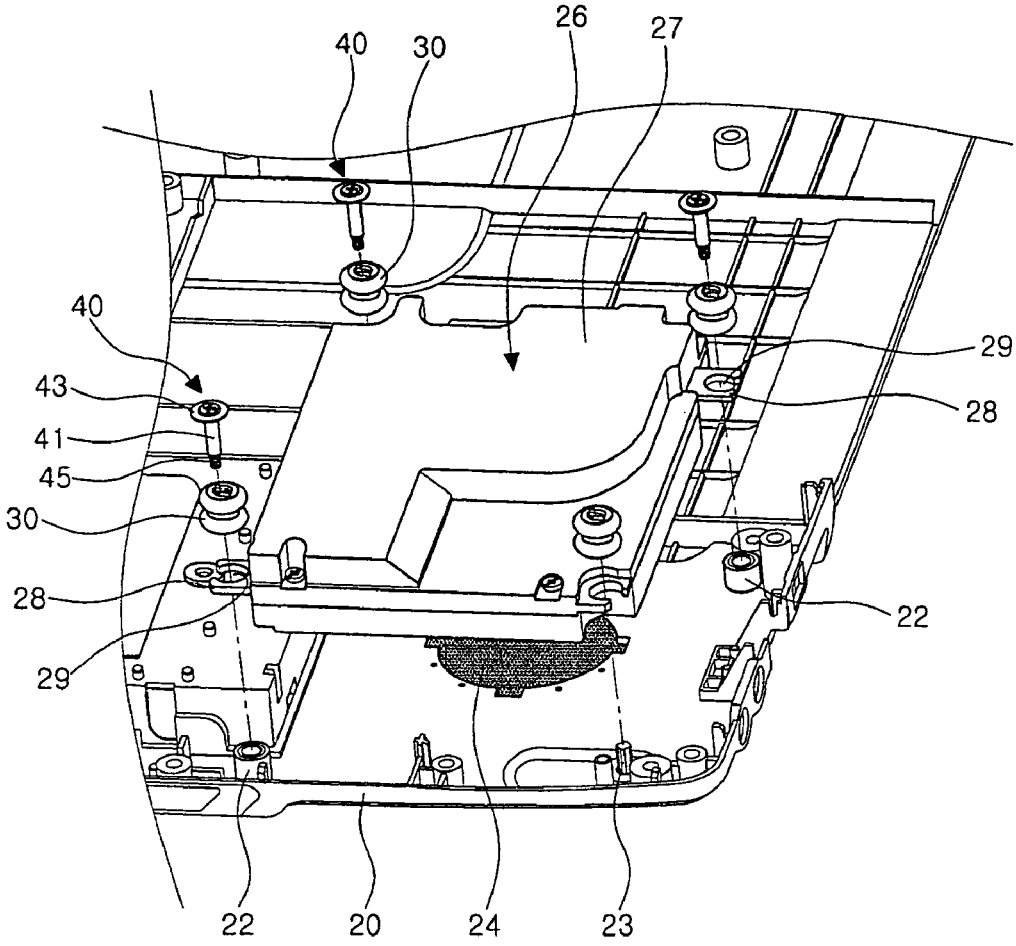

【FIG. 2a】
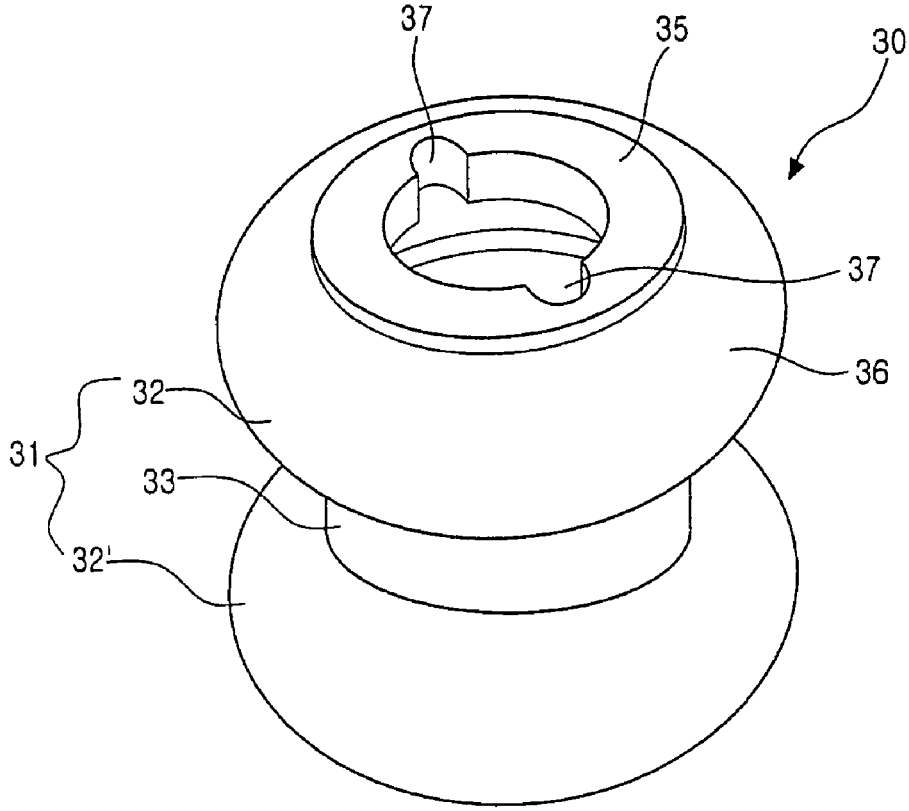

【FIG. 2b】
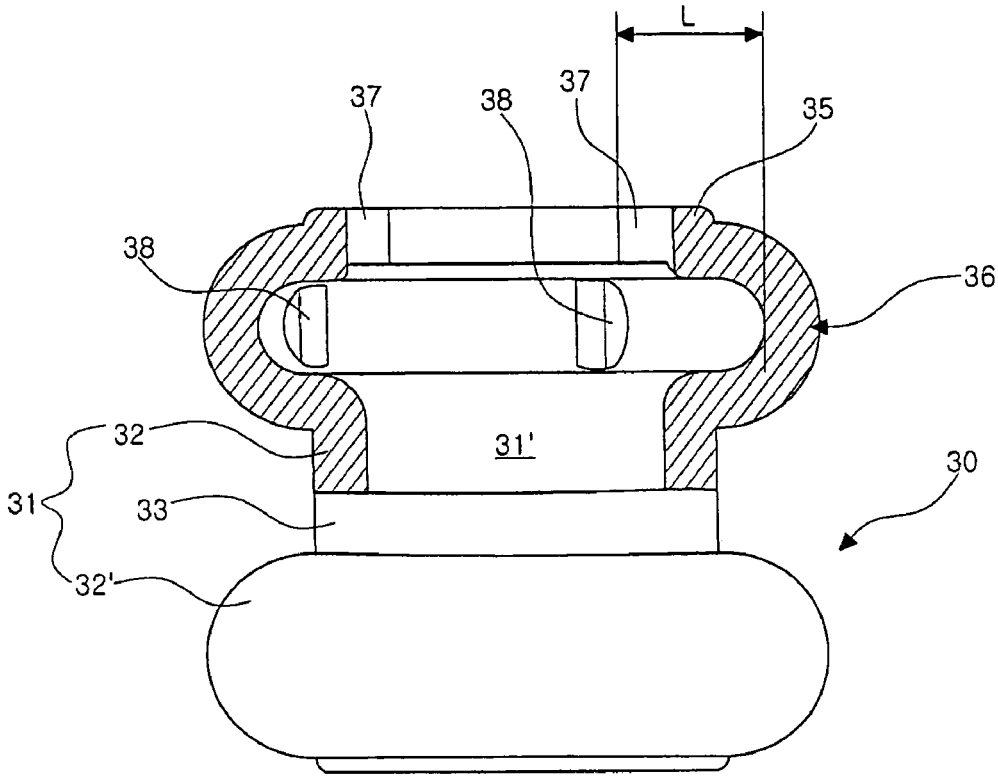

【FIG. 2c】
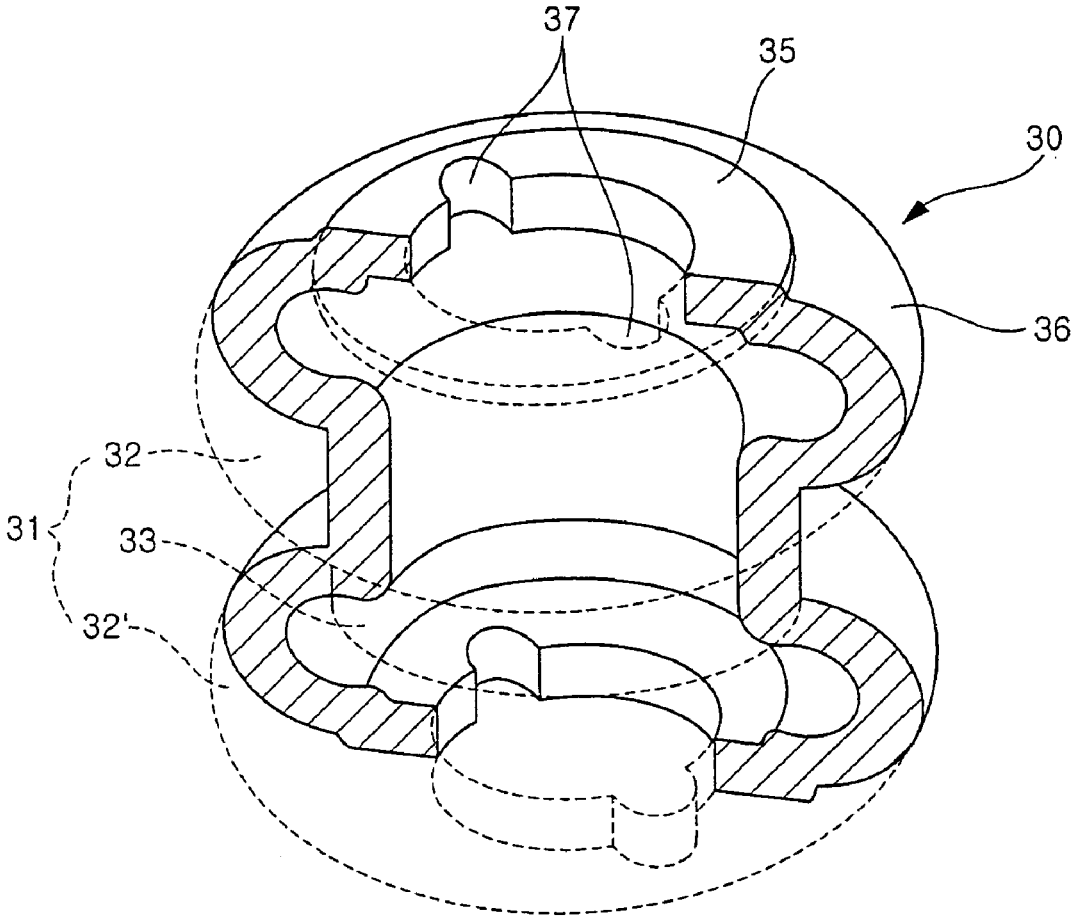

【FIG. 3】
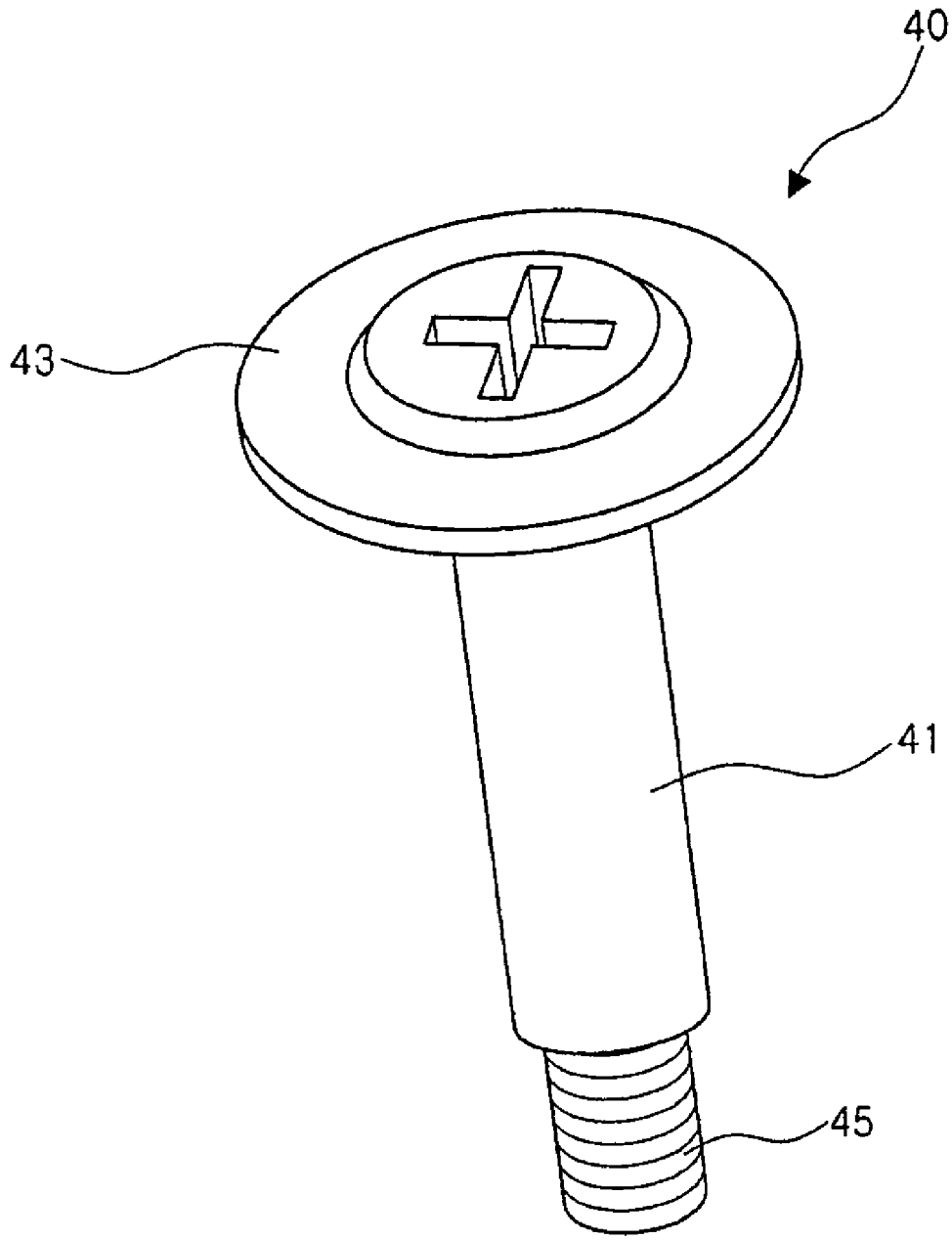

WOOFER SPEAKER MOUNTING STRUCTURE FOR PORTABLE COMPUTER

BACKGROUND OF THE INVENTION

1. Field of the Invention

The present invention relates to a portable computer, and more particularly, to a speaker mounting structure for a portable computer.

2. Background of the Related Art

As a multimedia function is increasingly added to a portable computer, a variety of speakers are used according to the multimedia function. To reproduce sound as close to the original sound as possible, a plurality of speakers for producing sounds with respective frequency ranges are used. Among them, a woofer speaker is used to produce bass sound, i.e., sound with a frequency range of 20 to 200 Hz.

However, as described above, the related art portable computer has various disadvantages. For example, when the woofer speaker is installed within a portable computer, various problems occur. That is, since the woofer speaker is mainly responsible for producing bass sound, many vibrations are generated during its operation. Since such vibrations generated from the woofer speaker have influence on a keyboard, there is a problem in that the operational reliability of the keyboard is deteriorated.

The above references are incorporated by reference herein where appropriate for appropriate teachings of additional or alternative details, features and/or technical background.

SUMMARY OF THE INVENTION

An object of the invention is to solve at least the above problems and/or disadvantages or to provide at least the advantages described hereinafter.

Another object of the invention is to provide a speaker mounting structure and methods thereof for a portable computer that can solve at least the above problems and/or disadvantages or to provide at least the advantages described hereinafter.

Another object of the invention is to provide a portable computer that can reduce or prevent vibrations generated from a speaker from being transmitted to other peripheral equipment.

Another object of the invention is to provide a speaker and methods thereof that can absorb vibrations from a woofer speaker by using the structural and material properties of a damper.

In order to achieve at least the above objects and advantages in a whole or in part, in accordance with one aspect of the invention, there is provided a woofer speaker mounting structure for a portable computer that includes a bottom case configured to be a part of an external appearance of a main body, a woofer speaker configured to produce bass sound and coupled to the bottom case by support pieces, dampers configured to engage the support pieces and fastening guiders, each of which includes a body and a head, wherein each fastening guider is configured to fasten to the bottom case with the body passing through the damper and the head positioned to hold the damper.

To further achieve at least the above objects and advantages in a whole or in part, in accordance with one aspect of the invention, there is provided a portable computer that includes a main body configured with a bottom case and a top case coupled to the bottom case, a display configured to display information thereon, wherein said display is coupled to the main body to be folded onto or unfolded with respect to the main body, a speaker configured to produce sound, said speaker positioned on one of the top case or the bottom case corresponding to the interior of the main body and formed with support pieces, at least one damper configured to absorb vibrations from the woofer speaker, said dampers being fitted to the support pieces and coupled to said one of the top or bottom case, and at least one fastener configured with a body whereby the body is fastened to said case with at least a portion of the body configured to enter the damper to position the damper.

To further achieve at least the above objects and advantages in a whole or in part, in accordance with one aspect of the invention, there is provided a portable computer that includes a main body including a bottom case formed with fastening bosses and a top case coupled to the bottom case, a display for displaying information thereon, said display being connected to the main body through a hinge unit to be folded onto or unfolded with respect to the main body, a damper for absorbing vibrations, a woofer speaker configured to produce bass sound, said woofer speaker being positioned in the main body by the damper, wherein the damper includes a damper body made of an elastic material configured with a central hole, upper and lower shock-absorbing portions each configured with reinforcing ribs formed on inner surfaces thereof at predetermined intervals, and a connection portion configured to connect the upper and lower shock-absorbing portions to each other.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIG. 1 is a diagram showing an exploded perspective view of a preferred embodiment of a woofer speaker mounting structure for a portable computer according to the present invention;

FIG. 2*a* is a diagram showing a perspective view of a damper according to the embodiment of the present invention;

FIG. 2*b* is a diagram showing a partially sectional front view of the damper according to the embodiment of the present invention;

FIG. 2*c* is a diagram showing a partially sectional perspective view of a cross section of the damper according to the embodiment of the present invention; and FIG. 3 is a diagram showing a perspective view of a fastening guider according to the embodiment of the present invention.

DETAILED DESCRIPTION OF PREFERRED EMBODIMENTS

FIG. 1 is an exploded perspective diagram showing an embodiment of a woofer speaker mounting structure for a portable computer according to the invention. FIGS. 2*a* to 2*c* are diagrams showing a perspective view, partially sectional front view, and partially sectional perspective view of a damper according to the embodiment shown in FIG. 1, respectively. FIG. 3 is a diagram showing a perspective view of a fastening guider according to the embodiment of the present invention.

As shown in FIGS. 1-3, a bottom case 20 can be a part constructing a main body of a portable computer and can generally define a lower appearance of the main body. A top case (not shown) can be coupled to the bottom case 20 to define an upper appearance of the main body. The main body can be substantially shaped as a rectangular plate. A plate-shaped display corresponding to the main body can be coupled to a rear end of the main body through hinge units such that the display can be folded onto or unfolded with respect to the main body. The display can serve to display information thereon.

The bottom case 20 can be formed with a plurality of fastening bosses 22 for the mounting of a woofer speaker 26. In the embodiment shown in FIG. 1, three fastening bosses 22 are provided. However, the invention is not intended to be so limited. Further, a guide boss 23 can be formed on the bottom case 20. Fastening guiders 40 can fasten to the fastening bosses 22, and one of dampers 30 can be fitted around the guide boss 23. The numbers of the fastening bosses 22 and the guide boss 23 can vary according to the design conditions.

A speaker grille 24 can be on the bottom case 20. The speaker grille 24 is preferably provided in an opening bored through the bottom case 20 and exposed to the outside at the bottom surface of the main body. The sound generated from the woofer speaker 26 can be transmitted to the outside (e.g., outside the portable computer) through the speaker grille 24.

The woofer speaker 26 generally produces bass sound. The woofer speaker 26 can be shaped as a flat hexahedron. However, the invention is not intended to be so limited. For example, the woofer speaker 26 may be designed to have any external appearance if the woofer speaker 26 can be installed within the main body of the portable computer. Protruding support pieces 28 can extend from a speaker case 27. For example, the support pieces 28 can be at four corners of the speaker case 27 that can define the external appearance of the woofer speaker 26. Each of the support pieces 28 can have a catching slot 29. The catching slot 29 can be bored through the support piece 28 and can have at least a portion opened toward an outer edge of the support piece 28.

The damper 30 can support the woofer speaker 26 on the bottom case 20. For example, the damper 30 can support the support pieces 28 and prevent the woofer speaker 26 from being brought into direct contact with the bottom case 20. A damper body 31 of the damper 30 can be a material capable of absorbing vibrations. As an example of the material of the damper 30, there is rubber, butyl, EPDM, or the like. The damper body 31 can be formed with a through hole 31' and can include upper and lower shock-absorbing portions 32 and 32' and a connection portion 33. The shock-absorbing portions 32 and 32' can have a vertical cross section substantially elliptic and the connection portion 33 that connects the upper and lower shock-absorbing portions 32 and 32' to each other can be cylindrical. The upper shock-absorbing portion 32 preferably has the same shape as that of the lower shock-absorbing portion 32'.

As shown in FIG. 2*b*, each of the shock-absorbing portions 32 and 32' can include a first shock-absorbing section 35 of which a distal end can define an inlet edge of the through hole 31', and a second shock-absorbing section 36 that can be a curved central portion of each shock-absorbing portion 32 or 32'. Each of the first and second shock-absorbing sections 35 and 36 can be elastically deformed to thereby absorb shocks when the shock is applied to the damper 30.

The first shock-absorbing section 35 can be analyzed in the form of a cantilever. For example, it can be considered that the first shock-absorbing section 35 is a cantilever with a length L extending from an inner surface of the damper body 31, corresponding to the second shock-absorbing section 36, to the inlet edge of the through hole 31'. The first shock-absorbing section 35 can be formed with shock-absorbing cutaway sections 37, which in turn can serve to cause the first shock-absorbing section 35 to be elastically deformed more smoothly. The two shock-absorbing cutaway sections 37 can be formed at the inlet edge of the through hole 31' to face each other. The shock-absorbing cutaway sections 37 can be formed to be symmetric with respect to the center of the inlet of the through hole 31'.

Preferably, the length of the shock-absorbing cutaway section 37 can be about L/4 to L/3, which is the result obtained by a shock-absorbing test for the damper 30. That is, when the length of the shock-absorbing cutaway section 37 is within the range of the above values, the damper 30 shows preferred shock-absorbing characteristics.

A reinforcing rib 38 can be formed in the damper body 31. The reinforcing rib 38 can be provided on the inner surface of the second shock-absorbing section 36. A plurality of reinforcing ribs 38 can be formed at regular angular intervals in each of the shock-absorbing portions 32 and 32'. In one embodiment, four reinforcing ribs 38 can be formed in each of the shock-absorbing portions 32 and 32' and placed, for example, at a 90 degree interval. The reinforcing ribs 38 can serve to reduce deformation or prevent the shock-absorbing portions 32 and 32' from being permanently deformed.

The fastening guider 40 can cause the damper 30 to be positioned on the fastening boss 22. The fastening guider 40 can be fastened to the fastening boss 22 while passing through the damper body 31 via the through hole 31' of the damper 30. The fastening guider 40 can include a body 41 with a diameter slightly smaller than or nearly equal to an inlet diameter of the through hole 31'. The length of the body 41 can be slightly higher than or equal to the height of the damper 30.

A head 43 can be formed on an upper end of the body 41. The head 43 is generally shaped as a disk with a diameter relatively larger than that of the body 41. The head 43 can be formed with a groove for a driver. Preferably, the diameter of the head 43 is not greater than an outer diameter of the shock-absorbing portion 32 or 32' of the damper body 31.

A thread portion 45 for the fastening to the fastening boss 22 can be formed on a distal end of the body 41 of the fastening guider 40. Thus, the thread portion 45 of the fastening guider 40 can fasten to the fastening boss 22.

According to embodiments of the invention, a woofer speaker can be supported by a damper without being brought into direct contact with a bottom case. Due to the structural and material properties of the damper, vibrations from the woofer speaker can be absorbed, and further, the deformation of the damper can be reduced or minimized. Thus, the operational reliability of a portable computer can be ensured and maintained for a long time.

As described above, embodiments of a mounting structure for a portable computer and methods thereof are described with respect to a woofer speaker. However, embodiments can be applied to any speaker or structure.

Operations of the woofer speaker mounting structure for a portable computer according to the invention will now be described. As shown in FIG. 1, the woofer speaker 26 can be supported on the bottom case 20 through the dampers 30. For example, the dampers 30 do not bring the woofer speaker 26 into direct contact with the bottom case 20 to thereby reduce or prevent vibrations from the woofer speaker 26 from being transmitted to other parts in the main body.

Installation operations of the woofer speaker 26 to the bottom case 20 will now be described. First, the connection portion 33 of the damper 30 can be fitted into the support piece 28 of the woofer speaker 26. The connection portion 33 can sit on the catching slot 29 of the support piece 28 such that the upper and lower shock-absorbing portions 32 and 32' are positioned above and below the support piece 28, respectively.

In such a state, the woofer speaker 26 can be affixed to the bottom case 20. At this time, the damper 30 fitted into the support piece 28 can be positioned at a position corresponding to the fastening boss 22 or guide boss 23.

Next, the fastening guider 40 can fasten to the fastening boss 22 through the through hole 31' of the damper 30. At this time, only the thread portion 45 formed on the distal end of the body 41 of the fastening guider 40 can be fastened to the fastening boss 22, and the body 41 can protrude from the fastening boss 22.

The damper 30 is preferably not compressed by the fastening guider 40. For example, the lower shock-absorbing portion 32' of the damper 30 can sit on the fastening boss 22, and the upper shock-absorbing portion 32 can be positioned below the head 43 of the fastening guider 40. Consequently, the woofer speaker 26 can be supported, due to its own weight, on the lower shock-absorbing portions 32' of the dampers 30. In addition, the vibrations generated during the operation of the woofer speaker 26 can cause the support piece 28 to elastically deform the upper and lower shock-absorbing portions 32 and 32' of the damper 30. Due to the elastic deformation of the shock-absorbing portions 32 and 32', the vibrations generated from the woofer speaker 26 can be absorbed.

Further, the damper 30 operates so that the first shock-absorbing section 35 can elastically deform like a cantilever to absorb shocks while the second shock-absorbing section 36 can absorbs shocks because of its own curved shape. Since the material of the damper body 31 also has predetermined elasticity, the shock-absorbing effect due to its own material can be also obtained.

In the first shock-absorbing section 35, the shock-absorbing cutaway section 37 can allow the distal end of the first shock-absorbing section 35 to be more easily elastically deformed. For example, if the whole inlet edge of the through hole 31' is uniformly formed in the first shock-absorbing section 35, the elastic deformation of the first shock-absorbing section 35 is reduced. However, because of the existence of the shock-absorbing cutaway sections 37, the first shock-absorbing section 35, particularly the distal end thereof, can be more easily elastically deformed, and thus, the shock-absorbing function can be increased or fully performed.

Further, the reinforcing ribs 38 in the second shock-absorbing section 36 can reduce or prevent the second shock-absorbing section 36 from being permanently deformed from the weight of the woofer speaker 26. Since the reinforcing ribs 38 can be at regular intervals, the elastic deformation of the second shock-absorbing section 36 is not seriously hindered.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. Furthermore, for ease of understanding, certain method procedures may have been delineated as separate procedures; however, these separately delineated procedures should not be construed as necessarily order dependent in their performance. That is, some procedures may be able to be performed in an alternative ordering, simultaneously, etc.

As described above, embodiments of a woofer speaker mounting structure for a portable computer and method thereof have various advantages. For example, in an embodiment, the woofer speaker can be installed on the bottom case with the dampers interposed therebetween. Since the woofer speaker is supported by the dampers, the woofer speaker can not directly contact the bottom case. Therefore, vibrations generated from the woofer speaker are not transmitted to the bottom case or the transmission is reduced, and thus, the operational reliability of the portable computer in which the woofer speaker is employed can be improved. Further, an embodiment of a damper can be configured to absorb vibrations from the woofer speaker using its structural and material properties. Therefore, there are advantages in that shocks and/or vibrations can be efficiently absorbed and permanent deformation can be hardly produced even though the damper is used for a long time.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A woofer speaker mounting structure for a portable computer, comprising:

a bottom case configured to be a part of an external appearance of a main body;

a woofer speaker configured to produce bass sound and coupled to the bottom case by one or more support pieces;

one or more dampers configured to engage the one or more support pieces; and fastening guiders, each of which includes a body and a head, wherein each fastening guider is configured to fasten to the bottom case with the body passing through the damper and the head positioned to hold the damper, wherein the damper comprises:

a damper body made of an elastic material configured with a longitudinal hole therethrough;

upper and lower shock-absorbing portions on the damper body; and a connection portion configured to connect the upper and lower shock-absorbing portions to each other and engage a corresponding support piece, wherein shock-absorbing cutaway sections in the upper and lower shock-absorbing portions form inlets receding from edges of the hole.

2. The woofer speaker mounting structure of claim 1, wherein a speaker grille is bored through the bottom case at a region corresponding to the woofer speaker.

3. The woofer speaker mounting structure of claim 1, wherein the bottom case includes at least one of fastening bosses fastened to the body of the fastening guiders or at least one guide boss configured to guide an installation of the damper.

4. The woofer speaker mounting structure of claim 1, wherein the upper and lower shock-absorbing portions include intermittent reinforcing ribs on inner surfaces thereof at predetermined intervals.

5. The woofer speaker mounting structure of claim 4, wherein a length of the shock-absorbing cutaway section is approximately within a range of L/4 to L/3 where L is a distance from an inner surface of the shock-absorbing portion, in which the reinforcing ribs are formed, to a portion corresponding to an edge of the inlet of the through hole.

6. The woofer speaker mounting structure of claim 1, wherein a length of the shock-absorbing cutaway section is approximately within a range of L/4 to L/3 where L is a distance from an inner surface of the shock-absorbing portion to a portion corresponding to an edge of the through hole.

7. The woofer speaker mounting structure of claim 6, wherein the shock-absorbing cutaway sections are at least substantially symmetric with respect to a center of an inlet of the through hole, and wherein the one or more support pieces are on an external surface of the woofer speaker.

8. The woofer speaker mounting structure of claim 1, wherein the hole is at an axial center of the damper, and wherein the fastening guider head is positioned above an upper end of the damper.

9. The woofer speaker mounting structure of claim 1, wherein the fastening guiders include a thread portion on a distal end of the body configured to engage a guide boss on the bottom case.

10. A portable computer, comprising:

a main body configured with a bottom case and a top case coupled to the bottom case;

a display configured to display information thereon, wherein said display is coupled to the main body to be folded onto or unfolded with respect to the main body;

a speaker configured to produce sound, said speaker positioned on one of the top case or the bottom case corresponding to an interior of the main body and formed with one or more support pieces;

at least one damper configured to absorb vibrations from the speaker, said damper being fitted to the one or more support pieces and coupled to said one of the top or bottom case; and at least one fastener configured with a body, wherein the body is fastened to one of the top or bottom case with at least a portion of the body configured to enter the damper to position the damper, wherein the damper includes:

a damper body made of an elastic material configured with at least one axial recess;

at least one shock-absorbing portion on the damper body; and a connection portion coupled to the at least one shock-absorbing portion and configured to engage a corresponding support piece, wherein shock-absorbing cutaway sections in the at least one shock-absorbing portion form inlets receding from an edge of the axial recess.

11. The portable computer of claim 10, wherein the at least one shock-absorbing portion include intermittent reinforcing ribs on inner surfaces thereof at predetermined intervals.

12. The portable computer of claim 11, wherein a length of the shock-absorbing cutaway section is approximately within a range of L/4 to L/3 where L is a distance from an inner surface of the shock-absorbing portion, in which the reinforcing ribs are formed, to a portion corresponding to the edge of the axial recess.

13. The portable computer of claim 10, wherein a length of the shock-absorbing cutaway section is approximately within a range of L/4 to L/3 where L is a distance from an inner surface of the shock-absorbing portion to a portion corresponding to the edge of the axial recess.

14. The portable computer of claim 10, comprising a guide boss protruding from the bottom case to engage the at least one axial recess of the dampers installed into the support pieces and a speaker grille is bored through the bottom case at a region corresponding to the speaker.

15. The portable computer of claim 10, wherein the at least one fastener includes fastening guiders, each of which includes a body and a head, wherein each fastening guider is configured to fasten to the bottom case with the body passing through the damper and the head positioned to hold the damper, and wherein the bottom case includes fastening bosses configured to connect to the fastening guiders.

16. A portable computer, comprising:

a main body including a bottom case formed with fastening bosses and a top case coupled to the bottom case;

a display for displaying information thereon, said display being coupled connected to the main body through a hinge unit to be folded onto or unfolded with respect to the main body;

a damper for absorbing vibrations;

a woofer speaker configured to produce bass sound, said woofer speaker being positioned in the main body by the damper, wherein the damper comprises:

a damper body made of an elastic material configured with a central hole, upper and lower shock-absorbing portions each configured with reinforcing ribs formed on inner surfaces thereof at predetermined intervals, and a connection portion configured to couple the upper and lower shock-absorbing portions to each other, wherein shock-absorbing cutaway sections in the upper and lower shock-absorbing portions are inlets of the central hole.

17. The portable computer of claim 16, wherein a length of the shock-absorbing cutaway section is within a range of L/4 to L/3 where L is a distance from an inner surface of the shock-absorbing portion, in which the reinforcing ribs are formed, to a portion corresponding to an edge of the inlet of the central hole.

18. The portable computer of claim 16, wherein shock-absorbing cutaway sections in the upper and lower shock-absorbing portions are inlets of the central hole configured to elastically deform the shock-absorbing portions as a cantilever.

* * * * *